US005853508A

United States Patent [19]

Tack et al.

[11] Patent Number: 5,853,508

[45] Date of Patent: Dec. 29, 1998

[54] WEAR RESISTANT EXTRUDED ALUMINIUM ALLOY WITH A HIGH RESISTANCE TO CORROSION

[75] Inventors: Louis Walter Marie Paul Tack, Reet, Belgium; Edouard Willem Suman, Alkmaar; Henricus Matheus Van Der Donk, Velserbroek, both of Netherlands

[73] Assignee: Hoogovens Aluminium NV, Belgium

[21] Appl. No.: 798,740

[22] Filed: Feb. 13, 1997

[30] Foreign Application Priority Data

Feb. 14, 1996 [BE] Belgium ..... 1002334

[51] Int. Cl.[6] ..... C22C 21/02

[52] U.S. Cl. ..... 148/550; 148/417; 148/439

[58] Field of Search ..... 148/439, 417, 148/550; 420/530, 532, 534, 535

[56] References Cited

U.S. PATENT DOCUMENTS

| | | | |
|---|---|---|---|
| 5,123,973 | 6/1992 | Scott et al. . | |
| 5,217,546 | 6/1993 | Eady et al. | 148/417 |

FOREIGN PATENT DOCUMENTS

| | | | |
|---|---|---|---|
| 0141501 | 5/1985 | European Pat. Off. . | |
| 5-179383 | 7/1993 | Japan | C22C 21/02 |
| 1437144 | 5/1976 | United Kingdom . | |
| 2159176 | 11/1985 | United Kingdom . | |
| 95/34691 | 12/1995 | WIPO . | |

OTHER PUBLICATIONS

Patent Abstracts of Japan, JP3075329, vol. 015, No. 238; Jun. 1991.

Patent Abstracts of Japan, JP62164846, vol. 12, No. 011; Jan. 1988.

*Primary Examiner*—Margery Phipps

*Attorney, Agent, or Firm*—Hunton & Williams; Kevin J. Dunleavy

[57] ABSTRACT

An aluminium alloy in extruded form, consisting of in weight %:

| | |
|---|---|
| Si | 11.0–13.5 |
| Mg | 0.5–2.0 |
| Fe | not more than 1.0 |
| Cu | not more than 0.35 |
| Zr | not more than 0.1 |
| Ni | not more than 0.1 |
| Cr | not more than 0.1 |
| Zn | ot more thane 0.1 |
| Sr | 0.02–0.1 |
| Mn | not more than 1.2 |
| Bi | not more than 1.0 |
| Pb | not more than 1.0 |
| Sn | not more than 1.0 |

balance Al and unavoidable impurities. This alloy has high wear resistance, good corrosion resistance and good machinability. It is particularly suitable for shaped articles used at below 150° C.

26 Claims, No Drawings

WEAR RESISTANT EXTRUDED ALUMINIUM ALLOY WITH A HIGH RESISTANCE TO CORROSION

FIELD OF THE INVENTION

The invention relates to an aluminium alloy in extruded form with high wear resistance, good corrosion resistance and good machinability. The invention also relates to a method for manufacturing such an aluminium alloy and, in addition, to the use of the aluminium alloy in shaped articles such as pistons for braking systems and pneumatic valves, particularly articles used not above 150° C.

DESCRIPTION OF THE PRIOR ART

For products which are suitable for use in applications demanding high wear resistance, for example pistons in a breaking system, aluminium alloys such as AA6262 and AA6061 are often used, which products are then provided with a hard, wear resistant surface layer, applied by hard anodization. Such a hard anodization layer is also quite resistant to corrosion. A disadvantage is that the application of an anodization layer is an additional process step, which is moreover expensive and thus has the effect of raising costs. Another disadvantage is that the anodization process is damaging to the environment. A further disadvantage is that for many applications, a good wear resistance and a good corrosion resistance are certainly important, but the results that can be obtained with a hard anodization layer are often much better than is necessary for the applications involved.

A review of prior art found in a search performed in relation to the present invention shows the following.

GB-A-1437144 discloses aluminium-silicon alloys primarily intended for use as cylinder block material for internal combustion engines. Detailed casting conditions are specified. The alloys have the composition, in weight %

| | |
|---|---|
| Si | 11–20 |
| Mg | 0–4 |
| Cu | 0–4 |
| Fe | 0–1.5 |
| Sr | 0–0.1 |
| Na | 0–0.1 |

balance aluminium and impurities.

The specific alloys disclosed are

| | |
|---|---|
| Si | 14.4 |
| Sr | 0.017–0.023 |
| Mg | 0.45–0.52 |

balance aluminium.

Sr and/or Na are included for modification of the microstructure.

EP-A-141501 discloses an extruded aluminium alloy having high wear resistance and good cuttability, for use in parts subjected to frictional forces, e.g. pistons. The alloy is principally, in weight %

| | |
|---|---|
| Si | 12–30 |
| Cu | 0.3–0.7 |

Mg optionally 0.3–2.0

Sr and/or P optionally 0.005–0.1

Ni, Fe, Mn optionally 0.5–3.0

Sn, Pb, Si optionally 0.1–1.0

Specific amounts for primary Si crystals and eutectic Si crystals of certain size ranges are required. The preferred ranges for Si and Cu are

| | |
|---|---|
| Si | 16–20 |
| Cu | 3–7 |

Cu is said to increase strength. Sr and P are used to render primary Si crystals finer. In the examples Si is generally above 15% and Cu above 2%. One example has Si 12%, Cu 1.1%, Mg 1%, balance Al.

GB-A-2159176 discloses a brazing alloy for use in assembling an aluminium heat exchanger consisting of, in weight %

| | |
|---|---|
| Si | 4.5–13.5 |
| Sr | 0.005–0.1 |
| Mg | optionally 0.3–3 |
| Cu | optionally 2.3–4.7 |
| Zn | optionally 9.3–10.7 |

balance Al.

Sr is included to improve brazability. The specific alloys disclosed include

| | |
|---|---|
| Si | 10 |
| Mg | 1.5 |
| Sr | 0, 0.03, 0.07 or 0.12. |

U.S. Pat. No. 5,123,973 describes a worked rod extrusion product for fabricating into products having high wear resistance, such as pistons or valves. The composition is

| | |
|---|---|
| Si | 11–13.5 |
| Cu | 0.5–1.45 |
| Mg | 0.8–3 |
| Ni | 0.5–2.95 |
| Fe | <1.0 |
| Cr | <0.1 |
| Zn | <0.25 |
| Sr | 0.01–0.5 |

balance Al.

It is mentioned that Sr is present for structural modification of Si particles or Si-containing particles. One aim is to achieve a uniform equi-axed structure substantially free of coarse intermetallics and primary silicon. This alloy is based on the AA4032 type for which the specified limit for Cu is 0.5–1.3 wt % and for Ni is 0.5–1.3.

WO 95/34691 describes aluminium alloy sheet, for mechanical, naval, aircraft and space applications. The alloy sheets are produced by casting the alloy, homogenization, and hot rolling to the desired thickness, followed by solution heat treatment, quenching and ageing. The composition is in weight %

| | |
|---|---|
| Si | 6.5–11 (preferably 6.5–8) |
| Mg | 0.5–1.0 |
| Cu | <0.8 |
| Fe | <0.3 |
| Mn | <0.5 and/or Cr <0.5 |
| Sr | 0.008–0.025 |
| Ti | <0.02 |

all other elements <0.2 balance Al.

Sr is stated to be present to modify the alloy to avoid the formation of primary Si and obtain a finely dispensed fibre eutectic structure.

Other prior art documents of interest are discussed in context below.

SUMMARY OF THE INVENTION

An object of the invention is to remedy at least one of the above disadvantages of known aluminium alloys used where high wear resistance is required, by providing a strong, sufficiently wear resistant, corrosion resistant aluminium alloy of good machinability, without the need for applying a hard anodization layer, which aluminium alloy has excellent properties that may be applied to components which, among other things, are in service subject to wear at a temperature lower than 150° C., such as, for example, in pistons for braking systems and pneumatic valves and shafts for transmissions, such as automatic transmissions.

The invention provides an aluminium alloy in extruded form, consisting of in weight %:

| | |
|---|---|
| Si | 11.0–13.5 |
| Mg | 0.5–2.0 |
| Fe | not more than 1.0 |
| Cu | not more than 0.35 |
| Zr | not more than 0.1 |
| Ni | not more than 0.1 |
| Cr | not more than 0.1 |
| Zn | not more than 0.1 |
| Sr | 0.02–0.1 |
| Mn | not more than 1.2 |
| Bi | not more than 1.0 |
| Pb | not more than 1.0 |
| Sn | not more than 1.0 |

balance Al and unavoidable impurities.

Preferably, the alloy essentially does not comprise any primary Si particles, or has primary Si particles which as to at least 70% by volume are less than 15 $\mu$m in diameter.

Since the aluminium alloy has a high Si content, but basically no primary Si particles or small ones only and preferably a modified eutectic microstructure, together with other elements comprising a sufficiently high Mg-content and a low Cu-content, a strong alloy is obtained, with sufficient wear resistance and resistance to corrosion to be applied, among other things, in pistons for braking systems and shafts for transmissions, such as automatic transmissions.

The Si-content in the aluminium alloy in accordance with the invention is in the range of about 11.0–13.5 weight %, and preferably at least 11.5 weight %, e.g. in the range of 12.0–13.0 weight %. It is known that aluminium alloys with an Si-content at or near the eutectic composition (approx. 12.8 weight % in binary AlSi alloys) are exceedingly wear resistant when the wear resistance is measured using the well-known pin-on-disk method, as emerges, for example from the publication by J. Clarke and A. D. Sarkar in wear, 54 (1979), page 7–16, FIG. 3. If the Si-content is higher than 12.8 weight %, then during the solidification of the alloy, primary Si particles can form. The primary Si particles which have formed are exceedingly hard and contribute to a high wear resistance. The formation and control of the primary Si particles in order to increase wear resistance is for example the object of the wear-resistant aluminium alloy described in U.S. Pat. No. 4,737,206. A disadvantage of the primary Si particles is that, with mechanical load they can break out of the aluminium matrix and can cause considerable damage if they get between moving parts of an apparatus. The advantage of the present invention is that a good resistance to wear is provided, without primary Si particles being present, other than those which could form under unfavorable solidification conditions.

The wear resistance of the alloy is further increased through modification of the eutectic Si by the addition of 0.02–0.1 weight % Sr. The Sr content lies preferably in the range of about 0.02–0.04 weight %. A particular advantage of the addition of Sr in this range is that the formation of primary Si particles is suppressed. The primary Si particles which are still possibly formed are preferably mainly, e.g. at least 70% by volume, smaller than 15 $\mu$m.

The Mg-content in the alloy of the invention is in the range of 0.5–2.0 weight % and preferably 0.9–2.0 weight % and more preferably 1.0–1.4 weight %. The addition of Mg in the alloy ensures the required increase in strength compared to the binary AlSi alloy, by the formation of $Mg_2Si$ particles during the heat treatment after hot working. An increase in strength with regard to the binary AlSi alloy is required for a large number of applications of the alloy. An additional advantage of an increase in strength is that a strong matrix contributes to a higher wear resistance of the alloy.

Fe is unavoidably present as an alloying element in aluminium alloys. The Fe content in the alloy of the invention is a maximum of 1.0 weight % and preferably lower than about 0.7 weight %. An additional effect is that Fe can contribute to the strength of the alloy, by the formation of Al—Si—Fe phases. If, however, the Fe content is too high and/or the rate of cooling during solidification is too low, then the Al—Si—Fe phases can be too large and have a disadvantageous effect upon the strength and the wear resistance of the alloy.

The addition of Cu to an aluminium alloy generally leads, after heat treatment, to an increase in the mechanical properties of the alloy concerned, such as an increase in the tensile strength. Where there is an increasing Cu-content in the alloy, the corrosion resistance decreases, in particular the corrosion resistance in a chloride-containing environment decreases rapidly with an increasing Cu-content. In view of a number of applications in a corrosive environment, in order to achieve a good corrosion resistance in the aluminium alloy in accordance with the invention, preferably there is deliberately no Cu added to the alloy other than that is coincidentally or unavoidably present in the scrap used. The Cu-content in the alloy must be below 0.35 weight % and the resistance to corrosion is particularly good if the Cu-content is lower than about 0.1 weight %.

The Ni-content in the alloy is preferably lower than about 0.1 weight %. In some wear resistant aluminium alloys, a high Ni-content is deliberately used, for example in the aluminium alloy as described in EP-A-540069, so that an $NiAl_3$-phase forms which contributes considerably to the wear resistance of the alloy. The addition of for instance 1.0–3.0% Ni is not within the invention. It may be supposed that it is generally known that, where there is an increasing Ni-content in the alloy, the high temperature properties increase. Such an improvement of the high temperature properties is not particularly sought by the invention, since applications up to a temperature of 150° C. are aimed at. Besides, the deliberate addition of Ni has the effect of raising costs. Ni may therefore be at impurity level only.

The mechanical properties of the aluminium alloy, such as tensile strength and yield strength, can be raised further by the addition of Mn. An additional advantage of an increase in strength is that a strong matrix contributes to a higher resistance to wear in the alloy. During the homogenisation heat treatment precipitates are formed, which contribute to the strength of the alloy. The Mn content is preferably in the range of about 0.4–1.2 weight %.

If a good machinability is desired for the application of the aluminium alloy, Bi, Pb or Sn can be added to the alloy, as individual elements, or in any combination. The advantage is that the elements Bi, Pb, or Sn, individually or in combination, they basically remain present as elements and will preferably be located at or in the vicinity of the grain boundaries.

When the aluminium alloy is being machined, short chips are obtained. The Bi, Pb or Sn content, individually or in combination, is preferably in the range of 0.2–1.0 weight %. The total of the Bi, Pb and Sn contents is desirably smaller than or equal to 1.0 weight %. Where there is a higher content, there is also an increased risk for the formation of cracks during casting.

The extruded aluminium alloy in accordance with the invention can be supplied as rods or other extruded shapes in various heat treated conditions, so-called tempers, after which it can be processed into products for a wide range of applications, where a hard anodizing step may not be required, a sufficiently wear-resistant surface layer being present. The rods can be for example round rods, hexagon rods, flat rods, solid sections or hollow sections. The rods are supplied in for example any of the tempers from the series T3, T351, T4, T451, T5, T6, T651, T8, T851, T9, etc., or an O temper as they are mentioned in Aluminum Standards and Data, published in 1988 by The Aluminum Association and incorporated herein by reference.

In addition, the invention is embodied in a method for manufacturing the aluminium alloy in accordance with the invention, wherein the method comprises the steps of, in succession, (a) casting the aluminium alloy, (b) homogenizing the cast aluminium alloy, (c) hot extruding the homogenized aluminium alloy, (d) a process step selected from (d) (i) solution heat treatment, and (d) (ii) quenching directly after the hot working of step (c), (e) ageing.

In this way, it is achieved that the alloy acquires excellent properties against a reasonable cost level for the applications which the inventors have in mind.

For casting the aluminium alloy into ingots or extrusion billets both continuous and semi-continuous casting processes can be used. Care must be taken that the formation of primary Si particles is prevented, by using a sufficiently high casting temperature and preventing turbulence in launders which may possibly be used. During casting, a relatively high cooling rate is preferably imposed, so that the formation of primary Si particles during solidification is suppressed and a fine eutectic microstructure is formed, which brings about an improvement in the wear resistance of the alloy.

After this, the alloy is homogenized. The aim of the homogenizing treatment is amongst other things, to homogenize the microstructure, to dissolve the Mg, to level off possible residual stresses resulting from the casting process, to form of Mn-containing precipitates if Mn is present, and to spheroidize Si particles. A homogenization for of 8–30 hours in a temperature in the range of 450°–560° C. is sufficient. A longer homogenization time is not disadvantageous, but is not required and only serves to raise the costs of production. Preferably, the alloy is homogenised for 20 –25 hours in a temperature range of 500°–540° C. More preferably, the alloy is homogenised for 20–25 hours in a temperature range of 520°–540° C.

After homogenization, the alloy is extruded into sheets, rods or wire or other shaped materials suitable for processing into products. The invention is preferably characterized by the ingot or extrusion billet being processed into rods via an extrusion process, wherein either direct or indirect extrusion may be used. The ingot temperature during extrusion is preferably in the temperature range of 450°–520° C. and more preferably in the temperature range of 500°–510° C. Hot rolling instead of hot extrusion is not within the invention.

After hot extrusion, a step (d) is performed which comprises solution heat treatment. For this, the alloy of the invention will preferably first cool down, after the hot extrusion. The cooling rate is not so important here. Cooling will typically take place in air. Thereafter, the alloy is heat treated by keeping it for 0.5–3 hours in a temperature range of 450°–565° C. The aim of this heat treatment, also known as solution heat treatment, is to dissolve, amongst other things, the Si and Mg. This solution heat treatment preferably takes place for 0.5–1.5 hours in a temperature range of 500°–560° C. Immediately after the solution heat treatment, the alloy is preferably cooled to under 100° C., preferably by means of quenching in water, in order to minimize uncontrolled precipitation.

In another embodiment of the method, quenching of the alloy takes place immediately after hot extrusion, by means of water, for example. This is also designated by the term "press-quenching". In order to bring sufficient Mg and Si into solution, in this case, the extrusion is preferably carried out in a temperature range of 520°–540° C.

In yet another embodiment of the method, step (d) also includes a cold working step. Depending upon the desired final level for mechanical and corrosive properties, cold working can take place after cooling, but before solution heat treatment, or else after quenching, following solution heat treatment. If the alloy of the invention is processed by means of press-quenching, cold working takes place after this step. Cold working preferably takes place by means of drawing, but rolling, for example, is a possibility. By the cold working, among other things, the tensile strength increases, as well as the wear resistance of the alloy.

In a following ageing step, the material is for example aged by 10–32 hours annealing in a temperature range of 145°–180° C. This annealing preferably takes place for 10–24 hours in a temperature range of 155°–180° C., after which cooling to room temperature takes place via cooling to the air.

After the complete heat treatment cycle, the aluminium alloy can be processed into products of many kinds. The aluminium alloy is preferably suitable for application to components which, amongst other things, are subject to wear during operation at temperatures lower than 150° C., for example, pistons for braking systems and pneumatic valves and for transmission shafts, such as automatic transmissions. The extruded aluminium alloy of the invention has excellent corrosion resistance in undoped oil, brake fluid and hydraulic oil. Components made from the aluminium alloy are especially suitable if they are built into a housing of aluminium-silicon cast alloys. Where there is co-operation between these cast alloys, a better fit is possible, and fewer leaks arise, since the thermal expansion coefficients of both types of alloys are almost the same. Furthermore, fewer problems arise with the recycling of the housing plus components as a whole.

Some preferred tempers for the alloy of the invention are given above. Rods made from the alloy can be processed into products by impact extrusion.

A method of processing for an "O" temper rod comprises:

(a) casting;

(b) homogenization;

(c) extrusion.

(a)–(c) are as described above. Then (c) is followed by (d) annealing, which in turn is followed by (e) cooling to a temperature of 150° C. (slow cooling is preferred, e.g. furnace cooling), and then cooling from 150° C. to room temperature where the cooling rate is not important Step (d) is typically performed for 1–16 hours in a temperature range of 300°–450° C., and preferably for 4–10 hours in a temperature range of 400°–450° C.

The invention is now illustrated by some examples, which do not limit the scope of the invention.

EXAMPLES

Table 1 lists the chemical composition in weight percent of some comparative materials (alloys 1–4 and 8) and alloys which fall within the scope of the invention (alloys 5–7). In all tables "n. t." means "not tested".

These alloys were processed into the T8 temper by the steps of i) after casting, homogenization at 530° C. for 24 hours ii) extrusion at 510° C.

iii) solution heat treatment at 530° C. for 35 minutes iv) quenching v) cold deformation of 1% by drawing vi) ageing for 16 hours at 165° C.

Table 2 lists the mechanical properties of some of the alloys from Table 1 in the T8 temper condition.

Table 3 lists the results of the salt-spraying test. A "–" indicates a bad result, whilst a "+" indicates good corrosion resistance, according to the salt-spraying test.

Test conditions were: temperature 21° C., pH=2.7, 0.86M NaCl and 0.16M acetic acid.

Table 4 lists the results of the wear tests, according to the well-known "pin-on-disk" method. Test conditions were: alloy condition T8; surface of the "pin": 100 $mm^2$; "disk" material: 110 Cr6 with a hardness of 58 HRC. Afterwards, in the non-lubricated tests: running speed 0.25 m/s for 20 hrs; air temperature 20°–25° C.; relative air humidity 40–60%. For the lubricated tests: running speed 0.01 m/s for 20 hrs; lubricating substance: undoped oil, BP Transcal M; temperature 40° C. The wear behavior is expressed as a so-called "wear-rate" with, as unit, $m^3$ / Nm and is dependent upon the pressure exercised in N during testing.

TABLE 1

| | Alloys tested | | | | | | | | |
|---|---|---|---|---|---|---|---|---|---|
| Alloy | Si | Fe | Mg | Mn | Cu | Ni | Sr | Pb | Bi |
| 1 | 13.2 | <0.3 | 0.65 | 0.42 | 2.0 | 2.0 | 0.1 | 0 | 0 |
| 2 | 12.3 | <1.9 | 1.05 | 0 | 0.9 | 0.9 | 0 | 0 | 0 |
| 3 | 12.5 | 0.22 | 0 | 0 | 0.04 | 0 | 0 | 0 | 0 |
| 4 | 12.3 | <1.0 | 1.05 | 0 | 0.9 | 0.9 | 0 | 0.4 | 0.4 |
| 5 | 12.8 | 0.5 | 1.0 | 0 | 0 | 0 | 0.03 | 0 | 0 |
| 6 | 12.8 | 0.5 | 0.5 | 0 | 0 | 0.1 | 0.03 | 0 | 0 |
| 7 | 12.8 | 0.5 | 1.2 | 0.7 | 0 | 0 | 0.035 | 0.40 | 0.40 |
| 8 | 0.5 | 0.6 | 1.0 | 0.1 | 0.3 | 0 | 0 | 0 | 0 |

TABLE 2

| | Mechanical properties in T8 condition | | | |
|---|---|---|---|---|
| Alloy | Yield Strength (MPa) | Tensile strength (MPa) | Elongation (%) | Hardness (HV) |
| 1 | 370 | 400 | 3 | 140 |
| 2 | 360 | 385 | 5 | 130 |
| 3 | 83 | 189 | 5.4 | 70 |
| 4 | n.t. | n.t. | n.t. | n.t. |
| 5 | 399 | 416 | 1.9 | 130 |
| 6 | 302 | 331 | 7.2 | 90 |
| 7 | 410 | 460 | 3 | 140 |
| 8 | n.t. | n.t. | n.t | n.t. |

TABLE 3

| | Results of the salt-spraying test | |
|---|---|---|
| Alloy | Surface Damage | Pitting frequency |
| 1 | –– | –– |
| 2 | – | ––– |
| 3 | n.t | n.t. |
| 4 | ––– | ––– |
| 5 | +++ | ++++ |
| 6 | + | – |
| 7 | n.t. | n.t. |
| 8 | ++++ | + |

TABLE 4

| | Results of the wear tests, in accordance with the "pin-on-disk" method, as function of the pressure for the non-lubricated and lubricated tests | | |
|---|---|---|---|
| | Non-lubricated | | Lubricated |
| Alloy | 50 N | 500 N | 1000 N |
| 1 | $54 \times 10^{-15}$ | $0.61 \times 10^{-15}$ | n.t. |
| 2 | $52 \times 10^{-15}$ | $0.16 \times 10^{-15}$ | n.t. |
| 3 | $70 \times 10^{-15}$ | n.t. | n.t. |
| 4 | $57 \times 10^{-15}$ | $0.41 \times 10^{-15}$ | n.t. |
| 5 | $43 \times 10^{-15}$ | n.t. | $0.11 \times 10^{-15}$ |
| 6 | $47 \times 10^{-15}$ | $0.52 \times 10^{-15}$ | $0.25 \times 10^{-15}$ |
| 7 | $50 \times 10^{-15}$ | $0.73 \times 10^{-15}$ | $0.31 \times 10^{-15}$ |
| 8 | n.t. | n.t. | n.t. |

From these results, it can be seen that the alloys 6, 7, and alloy 5, in particular, by comparison with the comparative materials, combine good mechanical properties with excellent corrosion resistance and good wear resistance.

In a further example of the invention, alloy 5 of Table 1 was processed into the O temper. The method comprised the steps (i) after casting homogenization at 530° C. for 24 hours, (ii) extrusion at 510° C., (iii) annealing at 440° C. for 8 hours, (iv) furnace cooling to 150° C., (v) cooling to room temperature.

In the 0 temper the product is suitable for processing by impact extrusion. Its mechanical properties were yield strength : 72 MPa;

tensile strength : 124 MPa;

elongation : 27%;

hardness 40 HB.

What is claimed is:

1. An aluminum alloy in extruded form which comprises substantially no Si particles, consisting of in weight %:

Si 11.5–13.5

Mg 0.5–2.0

Fe not more than 1.0

Cu not more than 0.35

Zr not more than 0.1

Ni not more than 0.1

Cr not more than 0.1

Zn not more than 0.1

Sr 0.2–0.1

Mn not more than 1.2

Bi not more than 1.0

Pb not more than 1.0

Sn not more than 1.0 balance Al and unavoidable impurities.

2. Aluminium alloy according to claim 1 wherein the Si content is 12.0–13.0 wt %.

3. Aluminium alloy according to claim 1 wherein the Sr content is 0.02–0.04 wt %.

4. Aluminium alloy according to claim 1 wherein the Mg content is 1.0–1.4 wt %.

5. Aluminium alloy according to claim 1 wherein the Fe content is not more than 0.7 wt %.

6. Aluminium alloy according to claim 1 wherein the Cu content is not more than 0.1 wt %.

7. Aluminium alloy according to claim 1 having a content of Mn of 0.4–1.2 wt %.

8. Aluminium alloy according to claim 1 containing at least one of Bi, Pb and Sn in a total content of 0.2–1.0 weight %, wherein the Bi, Pb and Sn present is in each case mainly in the elemental form in the aluminium alloy.

9. Aluminium alloy according to claim 1 which is in a temper selected from T4, T5, T6, T8 and 0.

10. A method for manufacturing an aluminum alloy comprising substantially no Si particles, consisting of in weight %:

Si 11.5–13.5

Mg 0.5–2.0

Fe not more than 1.0

Cu not more than 0.35

Zr not more than 0.1

Ni not more than 0.1

Cr not more than 0.1

Zn not more than 0.1

Sr 0.02–0.1

Mn not more than 1.2

Bi not more than 1.0

Pb not more than 1.0

Sn not more than 1.0 balance Al and unavoidable impurities, said method comprising the steps of, in succession, (a) casting the aluminum alloy, (b) homogenizing the cast aluminum alloy, (c) hot extruding the homogenized aluminum alloy, (d) a process step selected from (d) (i) solution heat treatment, and (d) (ii) quenching directly after the hot working of step (c), (e) ageing.

11. A method according to claim 10 wherein the homogenization of step (b) is for 8–30 hours in the temperature range 450°–560° C.

12. A method according to claim 10 wherein the homogenization of step (b) is for 20–25 hours in the temperature range 500°–540° C.

13. A method according to claim 10 wherein in step (c) said hot extruding is performed in the temperature range 450°–520° C.

14. A method according to claim 13 wherein said hot extruding is performed in the temperature range 500°–510° C.

15. A method according to claim 10 wherein said step (d) comprises said step (d) (i) of solution heat treatment, followed by quenching.

16. A method according to claim 15 wherein said solution heat treatment step (d) (i) is performed for 0.5 to 3 hours in the temperature range 450°–565° C.

17. A method according to claim 10 wherein in step (c) said hot working comprises extrusion performed in a is temperature range 520°–540° C., and said step (d) (ii) of quenching directly after said extrusion is performed.

18. A method according to claim 15 wherein said step (d) also includes cold working.

19. A method according to claim 1 wherein said step (e) of ageing is performed for 10–32 hours in the temperature range 145°–180° C.

20. An extruded aluminium alloy according to claim 1 in the form of a shaped article.

21. A method for manufacturing an aluminum alloy comprising substantially no Si particles, consisting of in weight %:

Si 11.5–13.5

Mg 0.5–2.0

Fe not more than 1.0

Cu not more than 0.35

Zr not more than 0.1

Ni not more than 0.1

Cr not more than 0.1

Zn not more than 0.1

Sr 0.2–0.1

Mn not more than 1.2

Bi not more than 1.0

Pb not more than 1.0

Sn not more than 1.0 balance Al and unavoidable impurities, said method comprising the steps of, in succession, (a) casting the aluminum alloy, (b) homogenizing the cast aluminum alloy, (c) hot extruding the homogenized aluminum alloy, (d) annealing the extruded alloy for 1–16 hours in the temperature range 300°–450° C., (e) slow cooling to 150° C., and (f) cooling to room temperature.

22. A method according to claim 20 wherein the annealing step (d) is performed for 4–10 hours in the temperature range 400°–450° C.

23. An extruded aluminium alloy made by a method according to claim 10 in the form of a shaped article.

24. An extruded aluminium alloy made by a method according to claim 21 in the form of a shaped article.

25. A shaped article according to claim 20 selected from a piston intended for use at below 150° C., a valve member and a transmission shaft.

26. A shaped article made by the method of claim 21 selected from a piston intended for use at below 150° C., a valve member and a transmission shaft.

* * * * *